US005991572A

United States Patent [19]

Cho

[11] Patent Number: 5,991,572

[45] Date of Patent: Nov. 23, 1999

[54] DOOR APPARATUS OF FIXING UNIT

[75] Inventor: Won-Mo Cho, Kyonggi-do, Rep. of Korea

[73] Assignee: SamSung Electronics Co., Ltd., Kyungki-do, Rep. of Korea

[21] Appl. No.: 09/200,413

[22] Filed: Nov. 27, 1998

[30] Foreign Application Priority Data

Nov. 27, 1997 [KR] Rep. of Korea ..... 97-34150

[51] Int. Cl.[6] ..... G03G 15/16

[52] U.S. Cl. ..... 399/122; 399/124

[58] Field of Search ..... 399/122, 320, 399/322, 124; 219/216, 469

[56] References Cited

U.S. PATENT DOCUMENTS

| | | | |
|---|---|---|---|
| 4,384,781 | 5/1983 | Takada | 399/122 |
| 4,598,990 | 7/1986 | Kusuoto et al. . | |
| 4,756,687 | 7/1988 | Cabrera et al. . | |
| 4,806,970 | 2/1989 | Nakatomi et al. . | |
| 4,965,640 | 10/1990 | Watarai et al. . | |
| 5,045,887 | 9/1991 | Nakamura . | |
| 5,179,415 | 1/1993 | Ikematsu et al. . | |
| 5,708,926 | 1/1998 | Sagara et al. | 399/122 |
| 5,826,141 | 10/1998 | Mitsuya | 399/122 |

FOREIGN PATENT DOCUMENTS

| | | |
|---|---|---|
| 3-208072 | 9/1991 | Japan . |
| 5-289570 | 11/1993 | Japan . |
| 5-289571 | 11/1993 | Japan . |

*Primary Examiner*—Robert Beatty
*Attorney, Agent, or Firm*—Robert E. Bushnell, Esq.

[57] ABSTRACT

A door apparatus of a fixing unit includes a guide door hinged to one side of a frame of the fixing unit, so that the guide door can be opened horizontally, securing enough space for removing a jammed sheet. The frame comprises a plurality of bent plates formed at the one side thereof, each of the bent plates having a hinge hole, and the guide door comprises a plurality of extending plates formed at one side thereof, extending horizontally with respect to the bent plates, each of the extending plates having a hinge pin. The hinge pins are inserted into the hinge holes. Further, the door apparatus includes a U-shaped lock having a fixed end and a free end, formed on the opposite side of the guide door such that an outer side of the free end elastically contacts an inner face of the other side of the frame. Further, the door apparatus includes a catch formed at a specified portion of the free end, slanted so as to insert smoothly into a receiving hole formed at a corresponding portion of the another side of the frame, so that the catch is inserted into the receiving hole to lock the guide door to the frame.

8 Claims, 6 Drawing Sheets

DOOR APPARATUS OF FIXING UNIT

CLAIM OF PRIORITY

This application makes reference to, incorporates the same herein, and claims all benefits accruing under 35 U.S.C. § 119 from an application for *DOOR APPARATUS OF FIXING UNIT* earlier filed in the Korean Industrial Property Office on the $27^{th}$ of Nov. 1997 and there duly assigned Serial No. 34150/1997.

BACKGROUND OF THE INVENTION

1. Field of the Invention

The present invention relates to the class of devices for performing electrophotography, and more particularly, to the class of devices known as fixing units which are used in electrophotographic devices.

2. Description of the Related Art

Electrophotographic devices are widely used in applications such as photocopying, laser printing and facsimile printing. An electrophotographic image forming apparatus is composed of a sheet feeding unit for feeding recording sheets one by one, an image forming unit for forming an image on the fed sheet with a toner, a fixing unit for fixing the toner on the sheet, and a sheet discharging unit for discharging the sheet with the toner fixed thereon. Further, the fixing unit is composed of a heating roller for melting toner particles covering a latent image on the sheet and a pressure roller for pressing the melted toner particles on the sheet, rotating in contact with the heating roller. It is often necessary for the user to access the fixing unit, especially in the case of a jammed sheet.

In one example of a fixing unit, a guide door is positioned where the sheet exits the rollers to help guide the sheet from the rollers. The guide door is hinged to open to allow access to the rollers in the event of a jammed sheet. The hinge axis of the guide door is parallel to the axis of the heating and pressure rollers, and the guide door moves vertically relative to the rollers and the frame. Upon opening the guide door around its hinge axis, there is not enough space for the user to have full access to the rollers. Therefore, it might be difficult for the user to completely remove the pieces of the jammed sheet.

This general arrangement of a guide door opening vertically relative to the rollers is illustrated in fixing devices seen, for example, in the following U.S. Patents. U.S. Pat. No. 4,598,990, is to Kusumoto et al., entitled *Toner Image Fixing Device*, describes a toner fixing device which is hinged on a shaft member to lift the supporting frame holding the heating to fixing roller. In this device an entire portion of the frame must be lifted to access the rollers as the hinge axis is parallel to the rollers. U.S. Pat. No. 4,756,687, to Cabrera et al., entitled *Roller Fuser Jam Clearance Mechanism*, describes a fixing unit with a handle for moving a sheet guide from the rollers. All of the movement of the parts occurs along axes parallel to the rollers, and the rollers are not fully accessible when open.

U.S. Pat. No. 4,806,970, to Nakatomi et al., entitled *Recording Apparatus Having An Accessible Housing*, describes a laser printer having a fixing unit, where the entire upper cover of the printer, containing many components, is hinged parallel to the rollers and must be lifted to access the interior. This patent also shows an upper frame of the fixing unit, hinged along an axis parallel to the rollers, which is rotated up to access the fixing unit. Even when the upper frame of the fixing unit is rotated up, it still does not provide full access to the rollers. U.S. Pat. No. 4,965,640, to Watarai et al., entitled *Image Forming Apparatus Including Detachable Toner Fixing Unit*, describes a fixing unit in which the entire upper frame, hinged parallel to the rollers, is lifted to access the fixing unit. Opening the frame loosens the contact between the rollers, but actual access to the rollers is limited. U.S. Pat. No. 5,045,887, to Nakamura, *Fixing Device With A Selectively Movable Cover*, describes a fixing device with a cover which rotates vertically to separate the heating and pressure rollers. The cover is hinged parallel to the rollers and does not open so as to give full access to the rollers. U.S. Pat. No. 5,179,415, to Ikematsu et al., entitled *Electro-Photographic Printing Apparatus Comprising A Toner Fixing Unit*, describes a fixing unit in which a sub-frame containing the pressure roller rotates away from the frame containing the heating roller to allow removal of jammed sheets. The subframe has a hinge axis parallel to the axis of the rollers. This arrangement does not allow access to the rollers while the rollers are together, however.

Based on my observation of the art, then, I have discovered that what is needed is a guide door for a fixing unit which allows full access to the rollers of the unit, especially to remove jammed sheets. Specifically, what is needed is a guide door which does not open vertically with respect to the fixing unit, and which is easy to open and close.

SUMMARY OF THE INVENTION

Therefore, it is an object present invention to provide an improved door apparatus of a fixing unit of an electrophotographic device.

It is another object to provide a door apparatus of a fixing unit which allows the user full access to the fixing unit.

It is a further object to provide a door apparatus of a fixing unit which allows the user access space to remove a jammed sheet from the fixing unit.

It is a yet further object to provide a door apparatus of a fixing unit which opens horizontally.

It is a still further object to provide a door apparatus of a fixing unit which is hinged to one side of the frame of the fixing unit.

Its is a still yet further object to provide a door apparatus of a fixing unit which is easily latched or opened by the user.

To achieve the above objects, there is provided a door apparatus of a fixing unit having a heating roller and a pressure roller mounted on a frame. The door apparatus includes a guide door hinged to one side of the frame so that the guide door can be opened horizontally, securing enough space for removing a jammed sheet.

Preferably, the frame includes a plurality of hinge plates formed bent from one side of the frame, these plates extending horizontally with respect to the frame, each of the bent plates having a hinge hole. The guide door has a plurality of extending plates formed at one side of the guide door, oriented parallel with respect to the bent plates of the frame, each of the extending plates having a hinge pin. The hinge pins are inserted into the hinge holes.

Further, the door apparatus includes a U-shaped lock having a fixed tab, or fixed end, and a flexible tab, or free end, formed on the opposite side of the guide door such that the outer side of the flexible tab elastically contacts the inner face of a second, opposite side of the frame. Further, the door apparatus includes a catch, or hook, formed at a specified portion of the flexible tab, slanted so as to slide smoothly upon closing the door, and a receiving hole formed at a corresponding portion of the another side of the frame, so that the catch is inserted into the receiving hole to lock the guide door to the frame.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
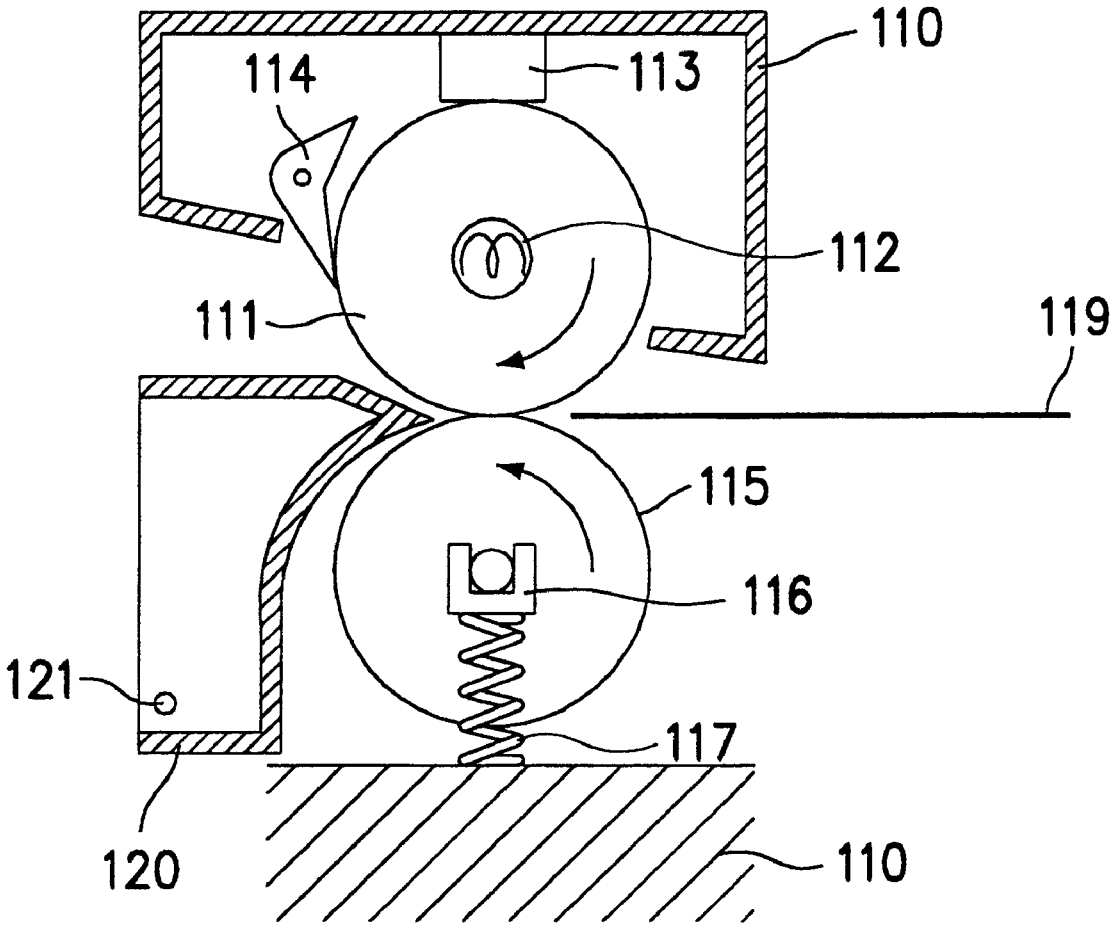
FIG. 1 is a vertical cross-sectional view of an exemplary fixing unit.
Figure 2:
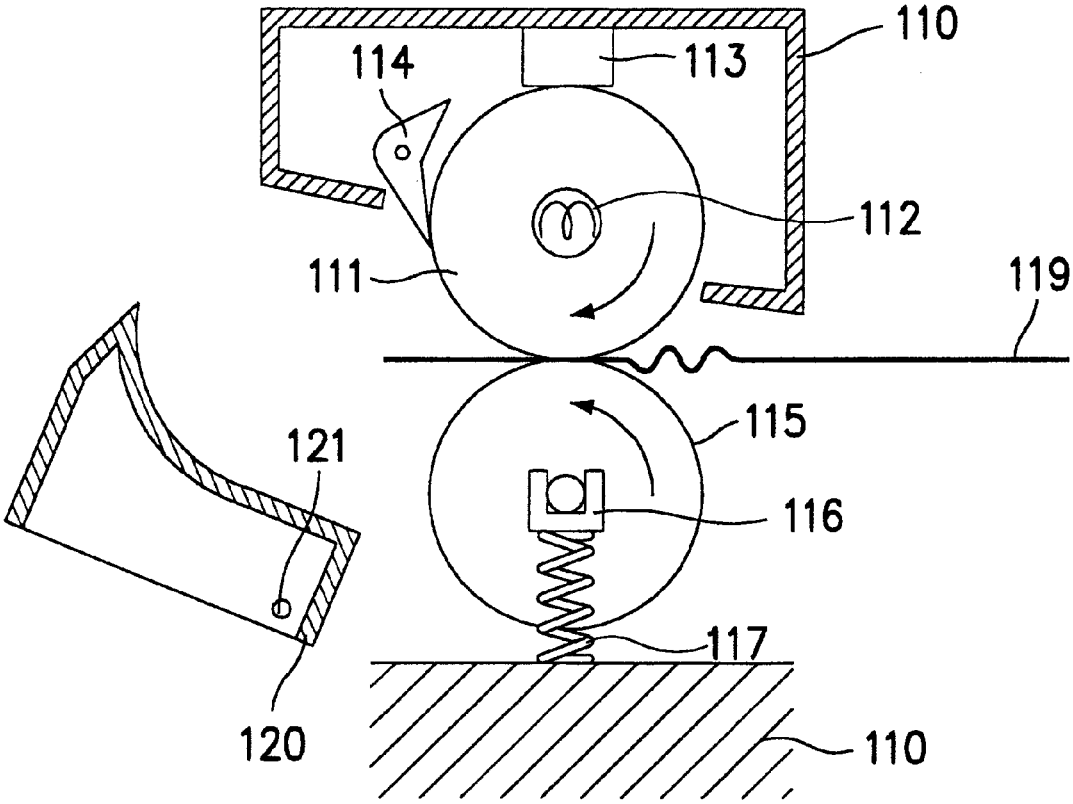
FIG. 2 is a vertical cross-sectional view of the fixing unit of FIG. 1, illustrating a state where guide door 120 is open.

Turning now to the drawings, FIG. 1 illustrates a cross-sectional view of a fixing unit with a guide door hinged parallel to the rollers of the fixing unit, and FIG. 2 illustrates a state where guide door 120 of this fixing unit is opened. Referring to FIGS. 1 and 2, the fixing unit includes heating roller 111 and pressure roller 115, mounted on frame 110 such that they rotate in contact with each other. As illustrated, heating roller 111 has heat lamp 112 secured therein, for generating a temperature of about 150–200° C. to melt the toner particles attached onto sheet 119. Temperature sensor 113 for sensing the surface temperature of heating roller 111 is mounted on frame 110, keeping in contact with the surface of heating roller 111. Further, at the sheet discharging unit side of the fixing unit, a plurality of fingers 114 are mounted on frame 110 in a lengthwise direction, keeping in contact with the heating roller 111, so as to separate sheet 119 from heating roller 111 and then guide sheet 119 to the sheet discharging unit.

Pressure roller 115 is installed below heating roller 111, applying a constant pressure to and rotating in contact with heating roller 111. Specifically, bushing 116 is fixed to an axle of the pressure roller 115, and compression coiled spring 117 intervenes between bushing 116 and the frame 110, so that pressure roller 115 can rotate keeping in contact with heating roller 111 by the pressure of compression coiled spring 117. In addition, at the sheet discharging side of the fixing unit, the openable guide door 120 is hinged around hinge axle 121, so as to allow a user to open guide door 120 and then remove a jammed sheet in the case that sheet 119 is jammed between heating roller 111 and pressure roller 115.

However, since guide door 120 opens downward around hinge axle 121, as seen in FIG. 2, it cannot be fully opened, and thus does not provide enough space for removing the jammed sheet. Therefore, it might be difficult for the user to completely remove the pieces of the jammed sheet.

A preferred embodiment of the present invention will be described in detail with reference to the accompanying drawings, in which the like reference numerals denote the like or equivalent elements. In the specification, well-known functions or constructions which may obscure the invention in unnecessary detail are not described in detail.

Figure 3:
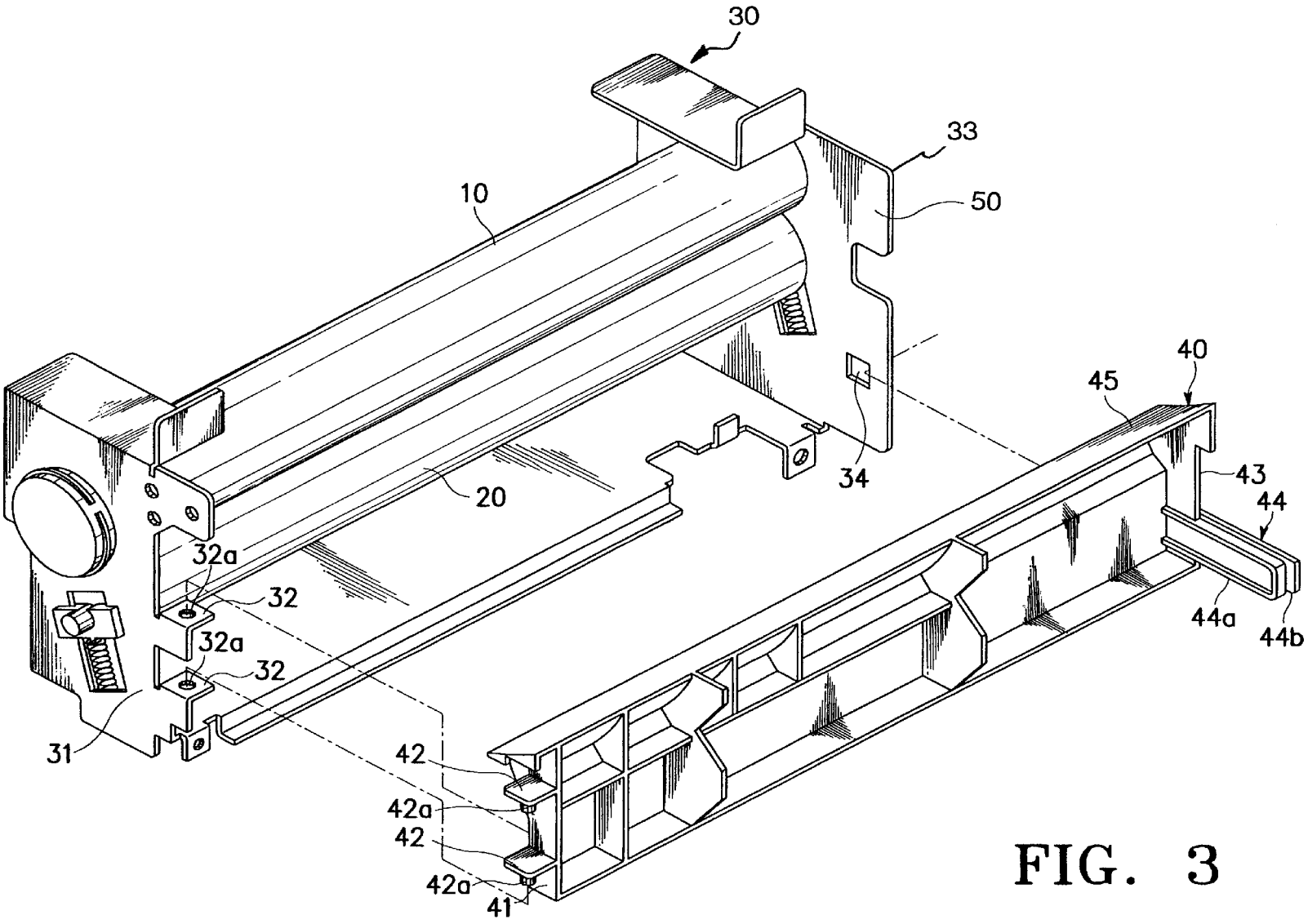
FIG. 3 is a perspective assembly diagram of a fixing unit with a door apparatus according to an embodiment of the present invention.

FIG. 3 is an assembly drawing of the fixing unit with a door apparatus according to an embodiment of the present invention. As illustrated, the fixing unit includes frame 30. Heating roller 10 and pressure roller 20 are installed in frame 30, and guide door 40 is hinged to one side of frame 30 so as to guide a sheet processed by the fixing unit and secure enough space for removing any jammed sheet.

Specifically, heating roller 10 and pressure roller 20 are mounted on frame 30 such that they can rotate keeping in contact with each other. Heating roller 10 has a heat lamp (not shown) for heating the circumference of heating roller 10 to melt the toner particles on the sheet passing through a gap between heating roller 10 and pressure roller 20, so as to fix the toner image on the sheet. Guide door 40 is hinged to one side of frame 30 so that it can be opened horizontally. Further, frame 30 has a locking mechanism on the other side from the hinge, for locking guide door 40 to frame 30 when guide door 40 is closed.

The fixing unit of the invention employs a hinge coupling structure for allowing guide door 40 to be opened horizontally with respect to frame 30. Specifically, at first wall 31 of frame 30, a plurality of hinge plates 32, which are bent rectangularly from first wall 31, are formed, extending horizontally with respect to heating roller 10 and pressure roller 20. Hinge plates 32 are perforated by hinge holes 32*a*. Further, at hinge side 41 of guide door 40, a plurality of extending plates 42, having hinge pins 42*a* for insertion into hinge holes 32*a*, are formed. Hinge pins 42*a* of guide door 40 are inserted into hinge holes 32*a* formed in hinge plates 32 of frame 30 thus forming the hinge coupling, so that guide door 40 can be rotated around the axis of the hinge in the horizontal direction. Note that the horizontal direction of rotation leaves face 52 (See FIG. 5) of guide door 40 vertical, and face 52 is essentially parallel to the axis of pressure roller 20 when guide door 40 is closed.

Figure 4:
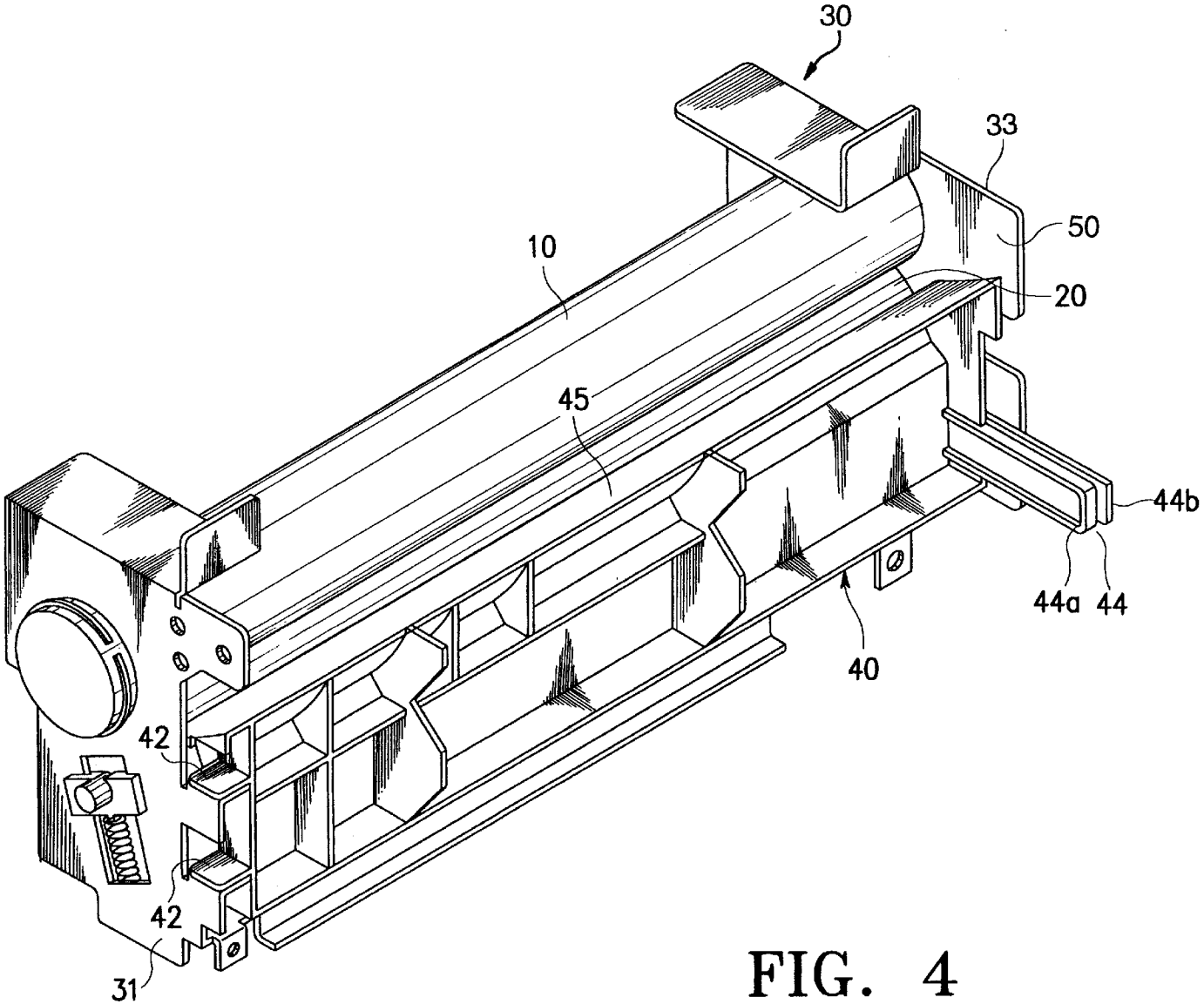
FIG. 4 is a perspective view of the fixing unit of FIG. 3, illustrating a state where guide door 40 is closed.

FIG. 4 is a perspective view of the fixing unit, illustrating a state where guide door 40 is closed. When guide door 40 is closed relative to frame 30, guide member 45 formed on an upper portion of guide door 40 is positioned to guide the sheet passing through a gap between heating roller 10 and pressure roller 20.

Figure 5:
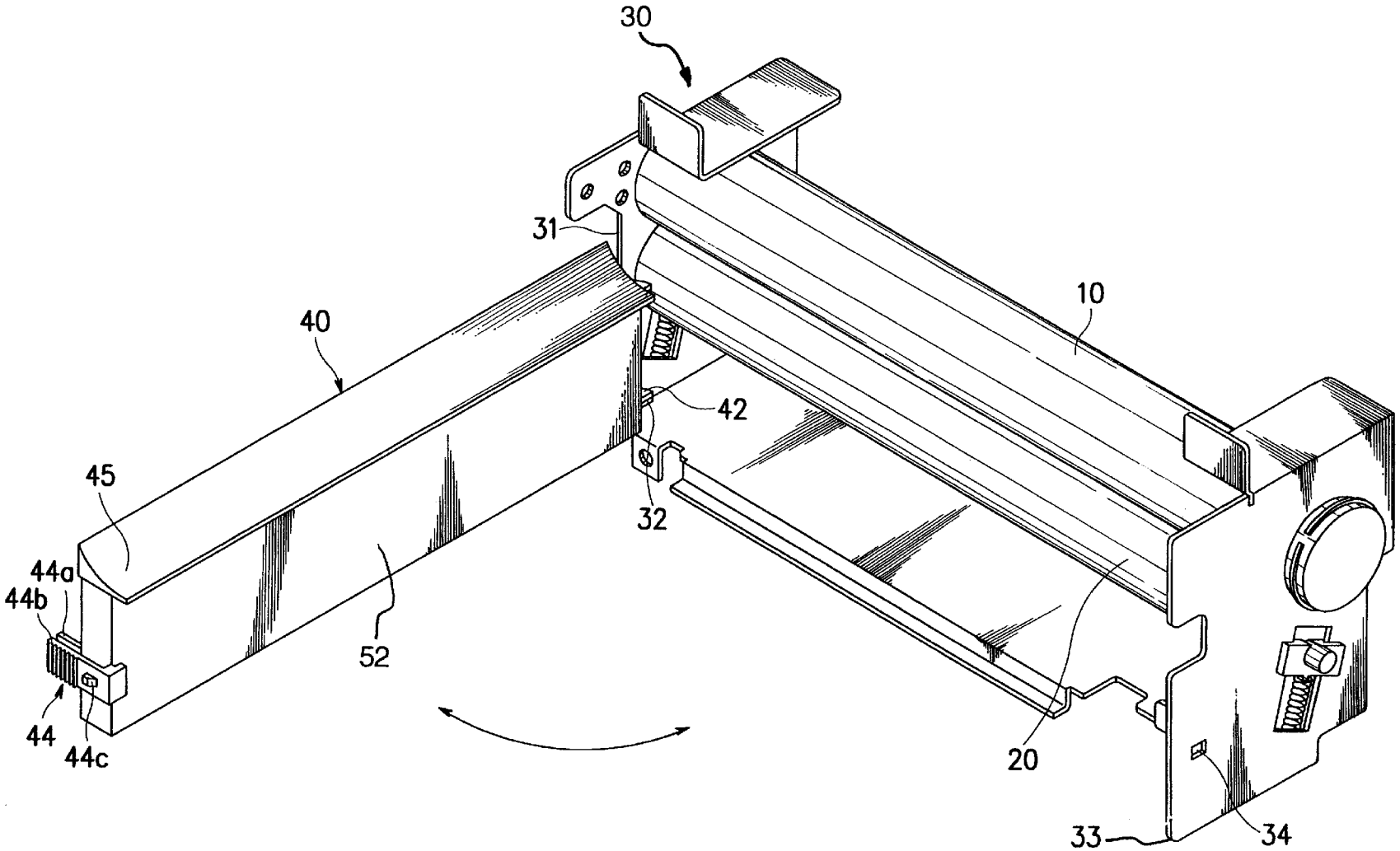
FIG. 5 is a perspective view of the fixing unit of FIG. 3, illustrating a state where guide door 40 is open.
Figure 6:
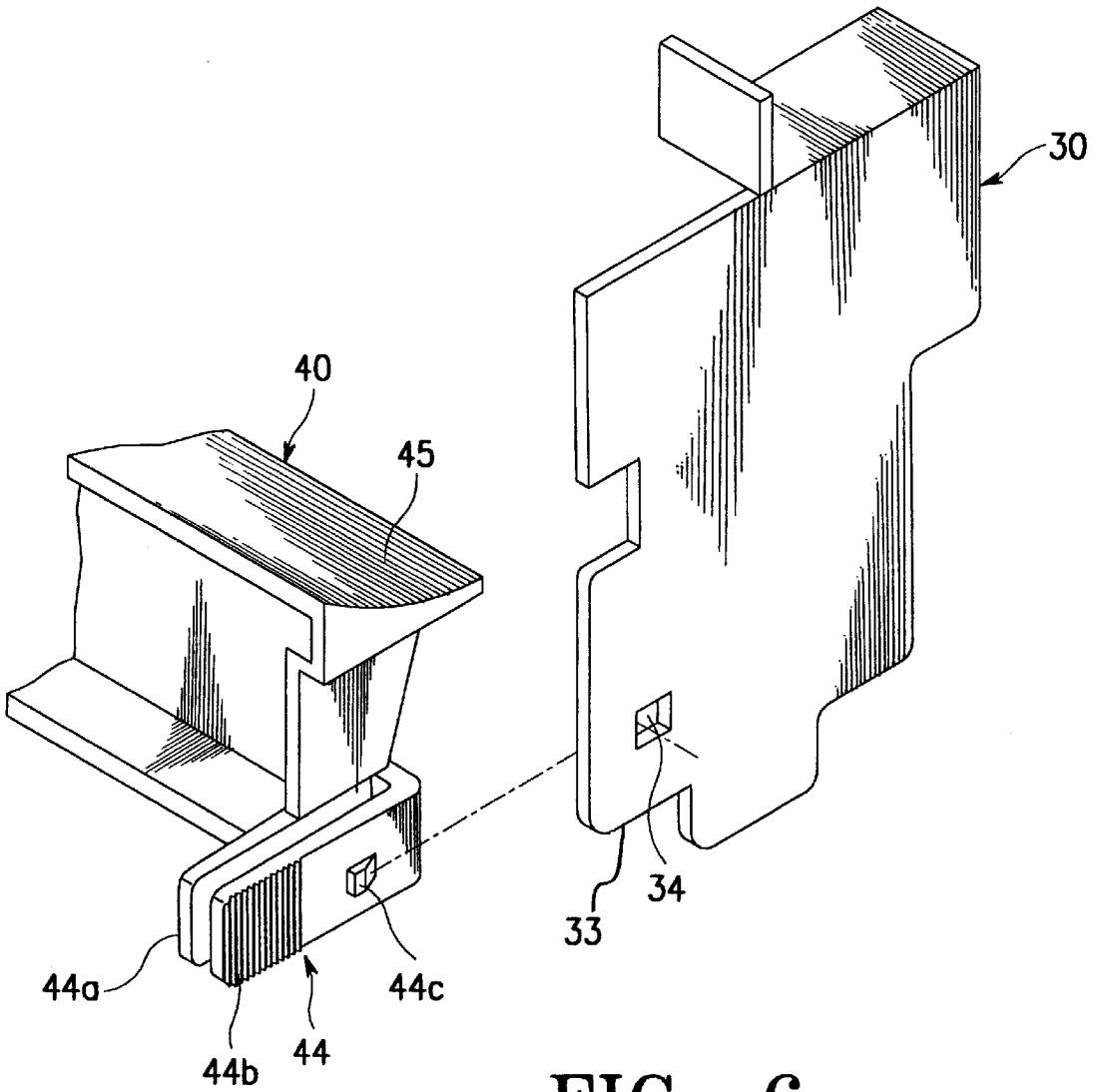
FIG. 6 is a partial perspective view of a locking device for the guide door according to an embodiment of the present invention.

FIG. 5 is a perspective view of the fixing unit, illustrating a state where guide door 40 is opened, and FIG. 6 is a partial perspective view of a locking device for locking guide door 40 to frame 30 when guide door 40 is closed. At opposite side 43 of guide door 40, lock 44, which is U-shaped, is formed. Lock 44 is made up of fixed tab, or fixed end, 44*a* and flexible tab, or free end, 44*b*, such that the outer side of flexible tab 44*b* elastically contacts inner face 50 of second wall 33 of frame 30. Specifically, fixed tab 44*a* is formed, extending outward, on opposite side 43 of guide door 40, and flexible tab 44*b*, which has the same length as fixed tab 44*a*, is formed to be elastically supported (or tensed) by fixed tab 44*a*. Fixed tab 44*a* is formed toward the inside edge of opposite side 43, and flexible tab 44*b* is formed toward the outside edge of opposite side 43. In addition, catch, or hook, 44*c*, which is slanted so as to slide smoothly when the door is being closed, is formed on a specified outer portion of flexible tab 44*b*, and receiving hole 34 is formed at a corresponding position on second side 33, so that hook 44*c* may be inserted into receiving hole 34. The slanted shape of hook 44*c*, as shown in FIG. 6, allows it to smoothly insert into receiving hole 34 when guide door 40 is closed.

In assembling guide door 40 into frame 30, hinge pins 42*a* of guide door 40 are inserted into hinge holes 32*a* of frame 30. If the user pushes opposite side 43 of guide door 40, guide door 40 rotates around the hinge coupling, and flexible tab 44*b* of lock 44 contacts inner face 50 of second wall 33. Here, if the user pushes opposite side 43 of guide door 40 more strongly, catch 44*c* formed on flexible tab 44*b* of lock 44 is inserted into receiving hole 34 formed in second wall 33, so that guide door 40 is locked to frame 30.

To open guide door 40 to remove a jammed sheet from the fixing unit, the user pushes the flexible tab 44*b* toward fixed tab 44*a*, for example, by pinching the flexible tab between the user's thumb and forefinger. Then, catch 44*c* formed on flexible tab 44*b* pulls out of receiving hole 34 of frame 30. Thereafter, if the user pulls on lock 44, guide door 40 is opened horizontally around the hinge coupler. Therefore, the portion of the fixing unit where the sheet is jammed can be completely exposed to the user.

As described above, the door apparatus of the fixing unit according to the present invention allows the guide door to be opened horizontally with respect to the frame. Therefore, it is possible to secure a wider space for removing the jammed sheet so that the user may easily remove the jammed sheet.

Although a preferred embodiment of the present invention has been described in detail hereinabove, it should be clearly understood that many variations and/or modifications of the basic inventive concepts herein taught which may appear to those skilled in the art will still fall within the spirit and scope of the present invention as defined in the appended claims.

What is claimed is:

1. A fixing unit assembly, comprising:

a frame;

a heating roller mounted in said frame, the axis of said heating roller defining a first direction in space;

a pressure roller mounted in said frame parallel to and touching said heating roller, the axes of said heating roller and said pressure roller defining a plane which contains said axes;

a guide door pivotally attached to said frame, said guide door having a face, said face being oriented essentially parallel to said first direction when said guide door is closed; and said guide door further comprising a hinge for attachment to said frame, the axis of said hinge being oriented perpendicular to said first direction.

2. The fixing unit of claim 1, further comprising:

the axis of said hinge of said guide door being oriented both parallel to said plane and perpendicular to said first direction.

3. The fixing unit of claim 1, further comprising:

said frame comprising a first wall and a second wall, said first wall and said second wall each being essentially flat and said first wall being parallel to said second wall;

a hinge plate formed at a right angle on said first wall of said frame, said hinge plate being perforated by a circular hinge hole;

said guide door comprising a hinge side and an opposite side, said hinge side being essentially flat;

an extending plate perpendicularly attached to said hinge side of said guide door;

a hinge pin perpendicularly attached to said extending plate; and said hinge pin being inserted in said hinge hole when said guide door is hinged to said frame.

4. The fixing unit of claim 1, further comprising:

said frame comprising a first wall and a second wall, said first wall and said second wall each being essentially flat and said first wall being parallel to said second wall;

a plurality of hinge plates formed at a right angle on said first wall of said frame, each of said hinge plates each being perforated by a circular hinge hole;

said guide door comprising a hinge side and an opposite side, said hinge side being essentially flat;

a plurality of extending plates perpendicularly attached to said hinge side of said guide door;

a plurality of hinge pins, each of said hinge pins perpendicularly attached to one of said extending plates; and said hinge pins being inserted in said hinge holes when said guide door is hinged to said frame.

5. The fixing unit of claim 1, further comprising:

a lock attached to said guide door to affix said guide door to said frame when said guide door is closed.

6. The fixing unit of claim 1, further comprising:

said frame comprising a first wall and a second wall, said first wall and said second wall each being essentially flat and said first side being parallel to said second side;

said second wall of said frame having an inner face facing said first wall of said frame;

said guide door further comprising a hinge side and an opposite side, said opposite side of said guide door having an inside edge and an outside edge;

a fixed tab extending from and parallel to said inside edge of said opposite side of said guide door;

a flexible tab extending from and parallel to said outside edge of said opposite side of said guide door, said flexible tab forming a U-shape with said fixed tab; and said flexible tab elastically contacting said inner face of said second wall of said frame when said guide door is closed.

7. The fixing unit assembly of claim 6, further comprising:

said second side of said frame being perforated by a receiving hole;

a catch formed on said flexible tab, said catch being slanted to said flexible tab; and said catch on said flexible tab being inserted into said receiving hole on said second wall of said frame when said guide door is closed.

8. The fixing unit assembly of claim 1, further comprising:

said guide door further comprising a guide member, said guide member contacting said pressure roller when said guide door is closed.

* * * * *